United States Patent [19]

Riedel

[11] 4,138,136

[45] Feb. 6, 1979

[54] SKI BRAKE

[75] Inventor: Tilo Riedel, Eching, Fed. Rep. of Germany

[73] Assignee: S.A. Etablissements Francois Salomon & Fils, Annecy Haute-Savoie, France

[21] Appl. No.: 712,958

[22] Filed: Aug. 9, 1976

[30] Foreign Application Priority Data

Aug. 8, 1975 [DE] Fed. Rep. of Germany ..... 2535552

[51] Int. Cl.[2] ..... A63C 7/10

[52] U.S. Cl. ..... 280/605

[58] Field of Search ..... 280/604, 605; 188/5

[56] References Cited

U.S. PATENT DOCUMENTS

| | | | |
|---|---|---|---|
| 3,909,024 | 9/1975 | Salomon | 280/605 |
| 3,992,030 | 11/1976 | Salomon | 280/605 |

FOREIGN PATENT DOCUMENTS

| | | | |
|---|---|---|---|
| 2501403 | 7/1975 | Fed. Rep. of Germany | 280/605 |
| 2255926 | 7/1975 | France | 280/605 |
| 2278363 | 2/1976 | France | 280/605 |
| 349911 | 12/1960 | Switzerland | 280/605 |

*Primary Examiner*—David M. Mitchell
*Attorney, Agent, or Firm*—Karl F. Ross

[57] ABSTRACT

A ski is provided with a heel clamp longitudinally slidable along the ski between a rear and a forward position and also pivotal on the ski between an up and a down position. A brake element is pivotal on the ski between a ready position extending parallel to the ski and a braking position extending generally normal thereto. A spring is provided for urging the brake element into the braking position. When a skiboot is securely held by the clamp it is in the down and rear position. When the boot is released and the clamp slides forwardly into the front position the abutments disengage to allow the brake element to assume the braking position. Similarly when the clamp pivots up into the upper position the brake element can assume the braking position. Pivoting of the clamp from the up to the down position automatically pushes the brake element back into the ready position.

7 Claims, 3 Drawing Figures

SKI BRAKE

CROSS-REFERENCE TO RELATED APPLICATIONS

This application is related to my copending patent applications Ser. Nos. 666,232 filed Mar. 12, 1976; 678,706 filed Apr. 20, 1976 and 707,453 filed July 21, 1976 and now abandoned.

BACKGROUND OF THE INVENTION

The present invention relates to a ski brake. More particularly this invention concerns such a ski brake usable in combination with a releasable boot clamp.

A ski brake is known such as described in my above-cited copending applications all of whose disclosures are herewith incorporated by reference which has a brake element pivotal on the ski between a braking position extending transverse, that is generally normal, to the ski and to the upper surface thereof so as to project below the ski and dig into the snow therebelow, and a retracted position generally parallel to the ski in no way impeding forward movement of the ski. Such a brake is provided on a ski in order to stop a runaway ski after the safety binding or similar devices released the ski from the skiboot of the user and any safety tie has broken. Such a runaway ski can cause considerable damage and poses a grave hazard for other skiers so that such a brake is a necessary safety device.

The problem with many of the prior-art arrangements is that they are set up so as to be mounted as an additional part of structure on the ski. Thus it is necessary for the user as he or she dons the ski to carefully make sure that the various toe and heel clamps of the ski are properly engaging his or her boot and at the same time that the ski brake is properly being pushed into the retracted or ready position. Furthermore the necessary complexity added to the various mechanisms on the ski by such a separate ski brake not only increases production cost but also greatly increases the likelihood of parts failure.

SUMMARY OF THE INVENTION

It is therefore an object of the present invention to provide an improved ski brake.

Another object is the provision of an improved combination ski, boot clamp, and ski brake.

Yet another object is the provision of such a ski brake which is less expensive to manufacture and less failure prone than the prior-art ski brakes.

Another object is the provision of a ski brake which is only brought into its ready and braking positions by means of one of the boot clamps of the ski, independently of whether the clamp is pivoted up or not.

These objects are attained according to this invention by arranging an abutment or portion of the spring-loaded ski brake or a part thereof and an abutment or a portion of the clamp so that when the skiboot is pulled out of the safety binding or the respective clamp this ski brake is actuated. This release position of the clamp can correspond to a pivoted-up and/or a longitudinally advanced position of the clamp on the ski.

The clamp may be the toe or heel clamp of the safety ski binding and the ski element may be formed as described in my above-cited patent applications. According to this invention displacement of the clamp into the holding position in which the skiboot is held by this clamp onto the ski automatically also displaces the brake into the ready or retracted position extending parallel to the ski. Thus merely by donning the ski the user automatically puts the brake into the desired operating position.

In accordance with this invention the ski element is pivotal on the ski about an axis perpendicular to the longitudinal direction of the ski and parallel to the upper surface thereof, and the clamp is pivotal about an axis behind this ski-element axis and parallel thereto. The abutment on the clamp overlies the abutment on the ski element, the up direction here being considered to be the direction perpendicular to the longitudinal direction of the ski and to the upper surface thereof, although it is noted that the device will function perfectly well if laid on its side or even upside down. Thus pivoting up of the ski clamp will automatically allow the brake element similarly to pivot. Furthermore according to this invention the ski clamp is slidable longitudinally on this ski and when slid into a forward position the two abutments are not engageable with each other so that the ski element again will automatically spring up into the braking position.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
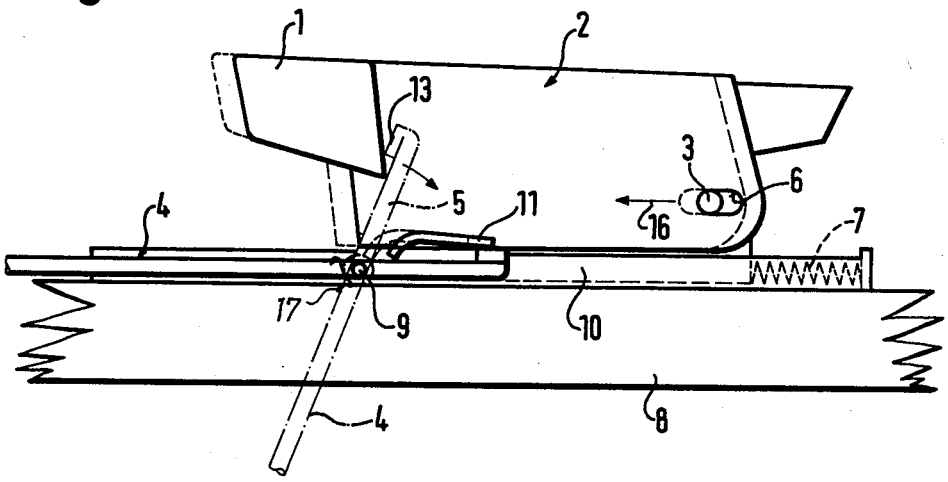
FIG. 1 is a side elevational view of the arrangement according to this invention showing in solid lines the clamp in the holding position and the braking element in the ready or retracted position.
Figure 2:
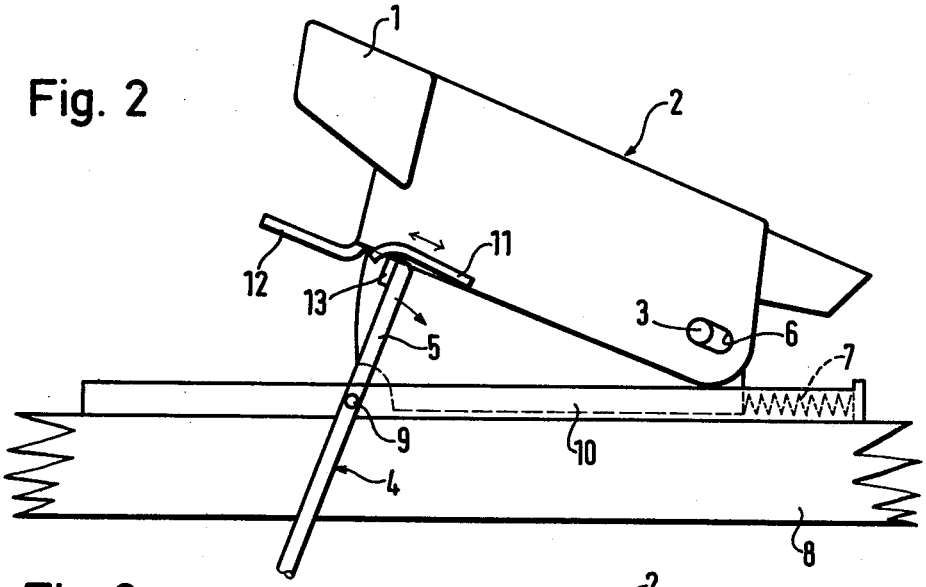
FIG. 2 is a view similar to FIG. 1 but showing the clamp in the release position and the brake element in the braking position.
Figure 3:
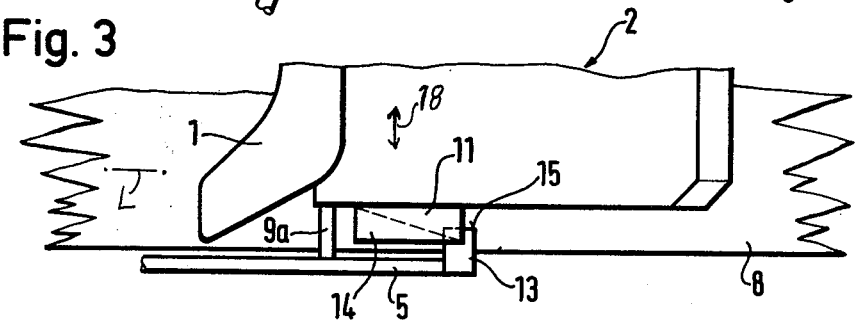
FIG. 3 is a top view of a portion of the arrangement shown in FIG. 1.

As shown in FIGS. 1–3 a heel-holddown member 1 is carried on a heel clamp 2 of a safety binding. This clamp 2 is arranged to pivot from the position of FIG. 1 to the position of FIG. 2 when stressed beyond a predetermined limit in order to release the boot of a skier so as to prevent a fracture of the leg.

This arrangement is provided with a brake element 4 such as described in my above-cited applications. This element 4 is elongated and pivoted on the ski about an axis 9 parallel to the upper surface of the ski and perpendicular to the longitudinal direction of the ski. FIG. 1 shows in solid lines how the element 4 lies parallel to the upper surface and longitudinal axis of the ski in a ready or retracted position and in dot-dash lines as well as in FIG. 2 in a pivoted position extending transverse to the ski so as to dig into snow underlying the ski and, therefore, brake the ski 8. A spring 17 is provided at the axis 9 for normally urging the element 4 relative to the ski 8 into the braking position.

The ski 8 carries a base plate 10 on which the heel clamp 2 is slidable in direction parallel to the longitudinal direction of the ski. A spring 7 urges the entire heel clamp 2 forwardly into the dashed-line position of FIG. 1. When a heel of a skiboot, however, is held down under the element 1 with the toe of the boot engaged in another clamp on the ski 8 the clamp 2 is in the rearward solid-line position. The housing of the clamp 2 is pivotal relative to the base plate 10 on a pin 3 extending through a longitudinally elongated slot 6 in the housing of the clamp 2. The pivot axis defined by this pin 3 is parallel to the pivot 9.

The clamp 2 is provided with a housing having a part constituting a laterally extending abutment or guide plate 11 formed with a downwardly curved front end and may be provided with an inclined camming surface 14 as shown in broken lines. The upper end 5 of the brake element 4 is provided with another abutment 13 in the form of a small plate normally underlying the plate 11; an inner edge 15 of abutment 13 may cooperate (not shown) with the camming surface 14. So long as the clamp 2 is in the rearward and down position illustrated in solid lines in FIG. 1 the plate 11 overlies the plate 13 and holds the brake element 4 in the retracted position against the force of the spring 16.

If the skiboot is disengaged from the clamp 2 so as to allow the spring 7 to push the clamp 2 forwardly in the direction indicated by arrow 16 in FIG. 1 into the dashed-line position of FIG. 1 the rear edge of the plate 11 will pass in front of the front edge of the plate 13 and allow the brake element 4 to pivot up into the dot-dash line position of FIG. 1. Furthermore as shown in FIG. 2 if the clamp 2 pivots upwardly about the axis 3 the element 4 will also pivot upwardly, as the abutment plate 11 is attached to this clamp housing 2.

The shaft 9*a* defining the pivot axis 9 for the brake element 4 is at least partially of flexible material so that as the brake element 4 is pivoted between the braking and ready positions the surfaces 14 and 15, insofar as they are provided, can coact to pivot the upper portion 5 of the element 4 outwardly away from the ski 8 by flexing the shaft 9*a* and thus bring the lower end toward the ski.

It is noted that the abutment plate 11 can be mounted in any manner known per se so that it may be displaced both in a direction 18 perpendicular to the longitudinal axis L of the ski and parallel to this axis L. Crossed slots in plate 11 and an arresting screw secured in clamp 2 and extending into the slots could be used, for example. Thus it is possible to adjust the setting of this element 11 and, therefore, of the brake element 4.

The clamp 2 is provided with a spring that normally urges it upwardly into the position shown in FIG. 2. In addition this clamp 2 has an internal latching mechanism which holds it down after a skiboot has exerted downward pressure on the sole or holddown plate 12 until a force exceeding a predetermined maximum is exerted on this clamp 2.

It is noted that the element 11 could be carried on the sole plate 12 as well as on the housing of the clamp 2. In addition it is possible to provide such an element 11 on the toe clamp of the safety ski binding. The element 13 similarly could be mounted at another location on the brake element 4. It is also within the scope of this invention to provide further linking elements between the elements 11 and 13.

It will be understood that each of the elements described above, or two or more together, may also find a useful application in other types of structures differing from the types described above.

While the invention has been illustrated and described as embodied in a ski brake, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination:

a ski having an upper surface and a lower surface and forward and rearward ends;

a boot clamp mounted on said ski and pivotally displaceable thereon about a clamp axis generally parallel to said surfaces between a holding position securing a skiboot to said ski and a release position in which said skiboot is freed from said ski by said clamp;

an elongated brake element pivotal on said ski about a brake axis generally parallel to said surfaces between a braking position extending generally normal to the planes of said surfaces of said ski and projecting beyond said lower surface of said ski and a retracted position extending generally parallel to said ski and lying generally above said lower surface of said ski, whereby in said braking position said element can dig into snow under said ski to brake same; and means including a rigid brake abutment fixedly mounted on said brake element and a rigid clamp abutment fixedly mounted on and extending laterally from said clamp in a direction generally perpendicular to the longitudinal axis of said ski and generally parallel to said upper surface thereof, and directly engageable with said brake abutment for displacing said brake element from said retracted into said braking position on displacement of said clamp from said holding into said release position.

2. In combination:

a ski having an upper surface and a lower surface and forward and rearward ends;

a boot clamp mounted on said ski and pivotally displaceable thereon about a clamp axis generally parallel to said surfaces between a holding position securing a skiboot to said ski and a release position in which said skiboot is freed from said ski by said clamp, said clamp having a rigid laterally projecting housing part which constitutes a clamp abutment;

an elongated brake element pivotal about a brake axis generally parallel to said surfaces between a braking position extending generally normal to said ski and projecting beyond said lower surface of said ski and a retracted position extending generally parallel to said ski and lying generally above said lower surface of said ski; and means including said clamp abutment and a rigid brake abutment fixedly mounted on said brake element and directly engageable with said clamp abutment for displacing said brake element from said retracted into said braking position on displacement of said clamp from said holding into said release position.

3. The combination defined in claim 2 wherein said means for displacing comprises spring means operatively engaged between said ski and said clamp normally urging said brake element into said braking position, said clamp being slidable longitudinally of said ski between a back position closer to said rearward end and a front position closer to said forward end and being pivotal relative to said ski between an up position and a down position, said front and up positions corresponding to said release position, the relative longitudinal lengths of said abutments being such that said abutments are mutually unengageable in said front position of said clamp.

4. The combination defined in claim 2, wherein said clamp includes a holddown plate provided thereon and engageable between said skiboot and said ski whereby said clamp is held in said holding position.

5. The combination defined in claim 2, wherein said brake abutment is a plate secured to said brake element and extending toward said clamp.

6. The combination defined in claim 2, wherein said ski is provided with a pivot carrying said clamp, said pivot being displaceable longitudinally of said ski.

7. The combination defined in claim 6, further comprising spring means urging said pivot longitudinally toward said forward end of said ski relative to a normal direction of travel thereof.

* * * * *